US005343816A

United States Patent [19]

Sideris

[11] Patent Number: 5,343,816

[45] Date of Patent: * Sep. 6, 1994

[54] REVOLVING BOOKCASE

[76] Inventor: Xen N. Sideris, 666 Georgia Ave., Palo Alto, Calif. 94306

[ * ] Notice: The portion of the term of this patent subsequent to Apr. 7, 2009 has been disclaimed.

[21] Appl. No.: 934,415

[22] Filed: Aug. 24, 1992

Related U.S. Application Data

[63] Continuation-in-part of Ser. No. 801,539, Dec. 2, 1991, Pat. No. 5,253,594, which is a continuation-in-part of Ser. No. 614,305, Nov. 16, 1990, Pat. No. 5,101,738.

[51] Int. Cl.[5] ..... A47B 57/00

[52] U.S. Cl. ..... 108/94; 211/163; 211/144; 411/383

[58] Field of Search ..... 108/94; 411/178, 180, 411/383, 384; 403/263, 230

[56] References Cited

U.S. PATENT DOCUMENTS

| | | | |
|---|---|---|---|
| 256,600 | 4/1882 | Schell | 108/94 |
| 1,884,491 | 10/1932 | Ziemann | 411/180 X |
| 3,003,648 | 10/1961 | LaVigne | 211/144 |
| 3,234,896 | 2/1966 | Bonsall | 108/111 |
| 3,430,531 | 3/1969 | Bosse | 411/178 X |
| 3,433,364 | 3/1969 | Chen | 211/144 X |
| 3,858,529 | 1/1975 | Salladay | 211/163 |
| 3,873,219 | 3/1975 | Pofferi | 108/111 X |
| 3,998,334 | 12/1976 | Smith | 211/163 X |
| 4,426,010 | 1/1984 | Le Mer | 211/144 |
| 5,101,738 | 4/1992 | Sideris | 108/94 |

*Primary Examiner*—Peter A. Aschenbrenner
*Attorney, Agent, or Firm*—Morrison & Foerster

[57] ABSTRACT

An attractive, sturdy revolving shelf unit which provides for efficient storage space for books, magazines, or wine bottles etc. Each shelf is characterized by an L-patterned arrangement of vertical supports between shelves which permit efficient storage and provide strength. Methods employed in manufacturing the storage units provide for easy adaptation to different sizes of the storage unit and variation in the size of the L-pattern to accommodate different storage items.

14 Claims, 6 Drawing Sheets

REVOLVING BOOKCASE

CROSS-REFERENCE TO RELATED APPLICATIONS

This is a continuation-in-part of pending U.S. Pat. Ser. No. 07/801,539, filed Dec. 2, 1991, which is a continuation-in-part of U.S. Pat. Ser. No. 07/614,305, filed Nov. 16, 1990, now U.S. Pat. No. 5,101,738.

1. Technical Field

The invention relates to furniture useful for storage of books and magazines, wine bottles, or other items. More particularly, it concerns a revolving shelf unit which provides efficient storage and strength.

2. Background Art

The general concept of convenient utilization of space for storing various items by using rotating mechanisms to provide maximum access is known. Very early U.S. Pat. Nos. 18,042; 111,608; 256,600; 489,652; 816,077; 836,947; and 1,224,083 describe various designs for rotating storage racks including bookcases and flower stands. U.S. Pat. No. 2,229,171 describes a rotating shelf which employs a tapered spindle having roller bearings to provide the desired rotation. U.S. Pat. No. 4,483,853 describes a rotating rack for baby food containers which rotates on rollers.

In addition, a number of revolving bookcases are on the market. These bookcases, generally, are relatively inefficient in their use of space because they preempt potential book space to accommodate materials that provide vertical support or they provide merely marginal vertical support with a marginal degree of structural rigidity. The present invention substantially offsets these limitations by means of an effective combination of "bookend" function, vertical support function and vertical/horizontal spacing function; moreover, with several minor optimal design modifications, the present free-standing revolving unit can be significantly enlarged and made into a sturdy practical floor-to-ceiling revolving unit that is compatible with typical household ceiling heights.

DISCLOSURE OF THE INVENTION

The invention provides a revolving storage shelf unit which efficiently stores books and magazines, which supports a large amount of unevenly distributed weight, and which is an attractive piece of furniture. The bookshelf is approximately square, may have one or a multiplicity of tiers, and utilizes the vertical support members as bookends, magazine guide rails and stops, so that the linear shelf space and shelf area are maximized.

Accordingly, in one aspect, the invention is directed to a revolving storage shelf unit for housing books, magazines, bottles, shirts, sweaters and other articles of similar form factors. The shelf unit comprises at least two shelf panels separated by vertical supports. The vertical supports (or standoffs) are arranged in "L" shape patterns with the long side of the L running just inside the edge of the shelf panel from one corner to an "interior" point, and the base of the L extending inward from this point to a second point. The locations of the "interior" point and the second point are determined by the form factor of the items to be stored. There are four such L-patterns configured on each tier of the rack. The four patterns provide both bookend spacing and vertical support for the shelf units. By virtue of the arrangement, there is little or no wasted space on the surface of the shelf units, and books, magazines and bottles can conveniently be fitted in four groups around the shelf units on each tier. The assembly is mounted on a base which allows the rack to rotate freely on the base. The base can be supplied with casters and/or glides. Further, the top of the unit can be supplied with a cover panel for utilitarian and for aesthetic reasons, viz., for masking the cavities which contain the means for securing the vertical supports.

In another aspect, the invention is directed to a method to manufacture the storage units from various materials using round female standoffs which include securing means at each end, such as threaded steel inserts for machine screw type fasteners, as vertical supports. Shelf panels are linked and sandwiched in place between sets of standoffs, each of which contains a set screw assembled into one of its steel inserts. The standoff set screws are then slipped through clearance holes provided in a fixed perforated pattern in the shelf panels and then assembled into the corresponding standoff of the adjacent storage tier.

In place of using set screws and inserts for machine screw type of fasteners one can make use of anchor bolts having a wood screw type end and a machine screw type second end.

BRIEF DESCRIPTION OF THE DRAWINGS

FIG. 4 is an illustration of a revolving storage shelf unit adapted for storage of wine bottles or the like.

MODES OF CARRYING OUT THE INVENTION

Revolving storage shelf units of the present invention are particularly useful in the storage of books, magazines, bottles, etc., as the arrangement of vertical supports permits optimizing the space provided by the shelf panels for such storage, but nevertheless maintains a high degree of strength, thus permitting the support of unevenly-distributed heavy articles. In a first preferred embodiment, the L-shaped arrangement of vertical supports is provided by standoffs which have been machined to include square-shouldered tenons at their ends for insertion into cavities provided in the shelf panels. Utilization of these approaches not only permits efficient manufacture of the racks, but also provides a high degree of stability even without use of adhesives or other additional securing means. A second preferred embodiment employs set-screw/insert pairs as securing means to attach the vertical supports to the shelf panels.

Thus, the invention, a revolving tiered storage unit, provides a sturdy revolving unit of tiered panels that efficiently stores books, magazines, etc. This unit, as a general assembly, is composed of the following: a storage unit assembly, which can have one or two or several tiers, a cover panel, a skirt, a circular base, and a turntable bearing assembly, which attaches to the base. The cover panel and the skirt, respectively, attach to the top and bottom shelf panels of the fully assembled storage unit. The storage unit assembly, with its foregoing respective attachments, is then attached to the turntable bearing which is already attached to the base, thereby completing the general assembly. The completed unit now floor mounts on casters or adjustable glides attached to the bottom of the disc and bearing assembly. See FIGS. 1, 2 and 3A–3D.

The construction of the storage unit assembly, the unit's major subassembly, can be modular and consists of multiple combinations of two distinct parts:

- a standard, e.g., (1" dia.×11-½" lg. cylindrical) standoff as vertical support member and
- a standard, e.g., (20¼"×20¼"×¾" square) perforated panel.

The standoffs have a combined function of bookend, storage bin delimiter, panel spacer, and load-bearing member. The perforated panels define the horizontal organization of the tiered storage shelves by means of their identical patterns of drilled holes into which the standoff tenons are press-fitted and glued, or through which screw type fasteners connect corresponding standoffs of adjacent storage tiers. For the storage unit assembly:

- if (T)=(the number of tiers), where T=1 or 2 or several,
- and (P)=(the number of perforated panels),
- and (S)=(the number of standoffs or vertical supports),
- then (P)=(T+1) and (S)=(16)×(T).

Hence, a typical 3-tiered storage unit assembly will have P=(3+1)=4 perforated panels and S=(16)×(3)=48 standoffs.

Figure 1:
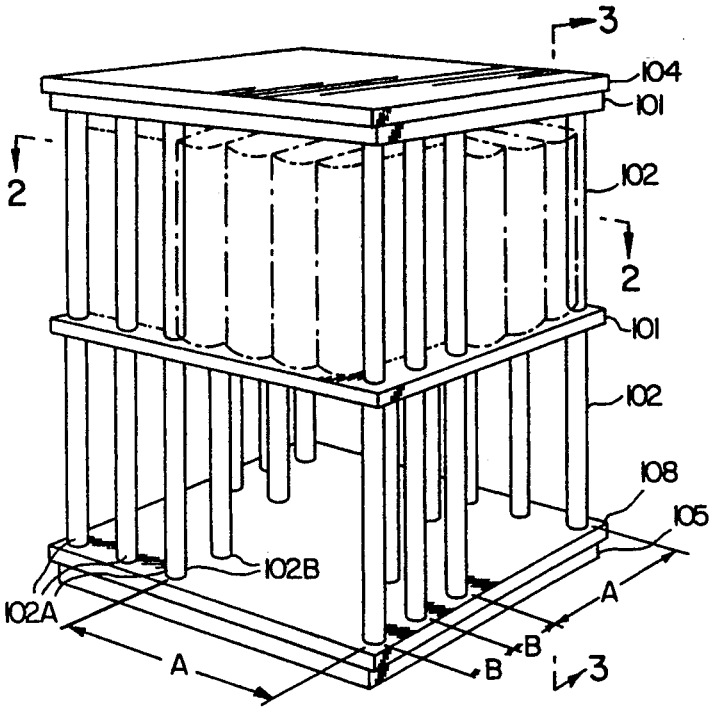
FIG. 1 shows a perspective view of one embodiment of the revolving storage shelf unit of the invention.
Figure 2:
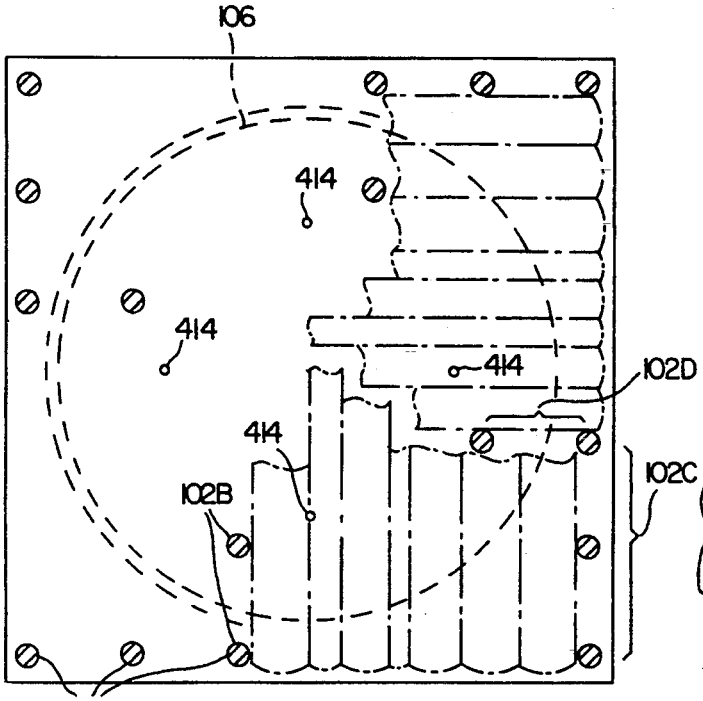
FIG. 2 shows a view along the line 2—2 of FIG. 1 looking downward through the rack.

The internal organization of a typical module consists of 4 sets of fixed bookends (2 standoffs per bookend, 2 bookends per set) arrayed in a basket weave pattern about the periphery of the module's perforated panels (see FIGS. 1 and 2). These 16 standoffs are centered on the corners of four A×B rectangles which are uniformly nested in the panel corners and at a fixed distance in from the panel edges; see FIG. 1. This layout coincidentally results in an L-shaped clustering of 4 standoffs, that is, 2 bookends (1 each from adjoining bookend sets) near each corner, thereby enhancing the strength and stability of the structure.

In the first preferred embodiment, the standoff is square-shouldered with identical square-shouldered tenons on each end. See FIG. 3A. These parts of the storage unit assembly will be assembled into two identical modules, each consisting of 2 perforated panels joined by a set of 16 standoffs. The two modules will then be joined into a tiered assembly by utilizing a third set of 16 standoffs, thereby producing a 3-tiered storage unit assembly.

In the second preferred embodiment, the same general assembly configuration is achieved by an alternate securing means. In this embodiment, the tenon-tipped cylindrical standoff configuration is replaced by the equivalent of a round female standoff, a configuration to which a set-screw is assembled. The panel configurations are also modified to provide loose slip fit holes for the standoff set screws.

The standoff assembly in this embodiment is a right circular cylinder with a coaxial blind hole (of suitable depth and diameter) in each end. Into each standoff blind hole a threaded steel insert (for machine screws) is assembled and bottomed so that it is fully recessed in the standoff. A set-screw (whose length is equal to twice the depth of the insert plus the thickness of a shelf panel) is then screwed into and bottomed in one of the standoff inserts, and secured using Locktite (TM) or similar means (FIG. 3B). Multiples of this assembly are later used to align and secure the various panels in their prescribed locations.

Shelf panels contain sixteen clearance holes of common diameter. This diameter insures close clearance fits for the sixteen standoff set-screws. In addition and if needed, the same hole pattern for the bottom shelf panel is countersunk or counterbored from the bottom side to insure that head screws assembled here will be fully recessed in the panel. (See FIGS. 3C and 3D.)

The cover panel in this embodiment has sixteen blind holes into which sixteen threaded steel inserts (identical to those assembled in the standoffs) are assembled. This hole pattern matches that of the adjacent shelf panel clearance hole pattern.

Figure 3A:
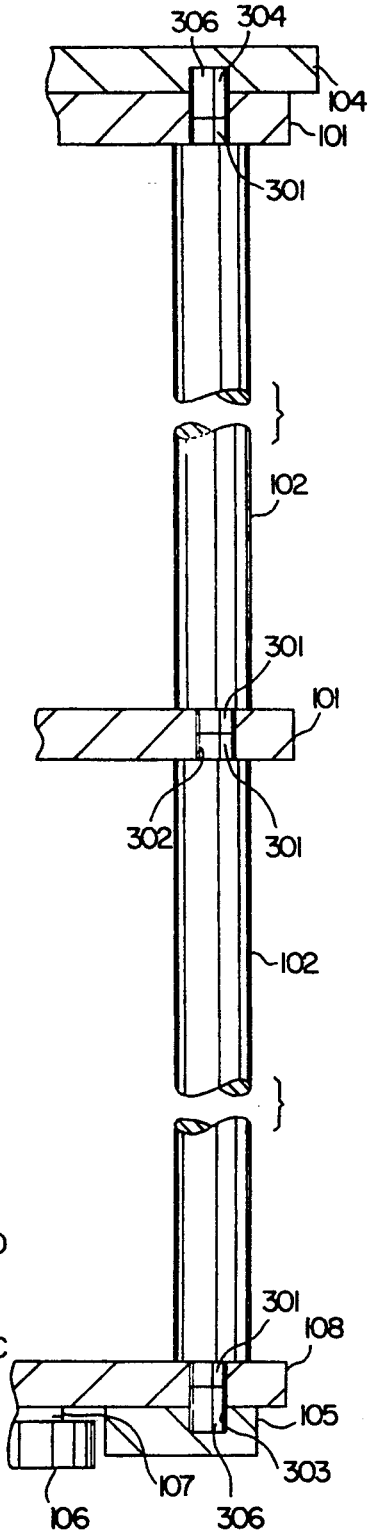
FIG. 3A is a view along the line 3—3 of FIG. 1 showing the integration of the support means when the standoff has square-shouldered tenons as securing means.
Figure 3B:
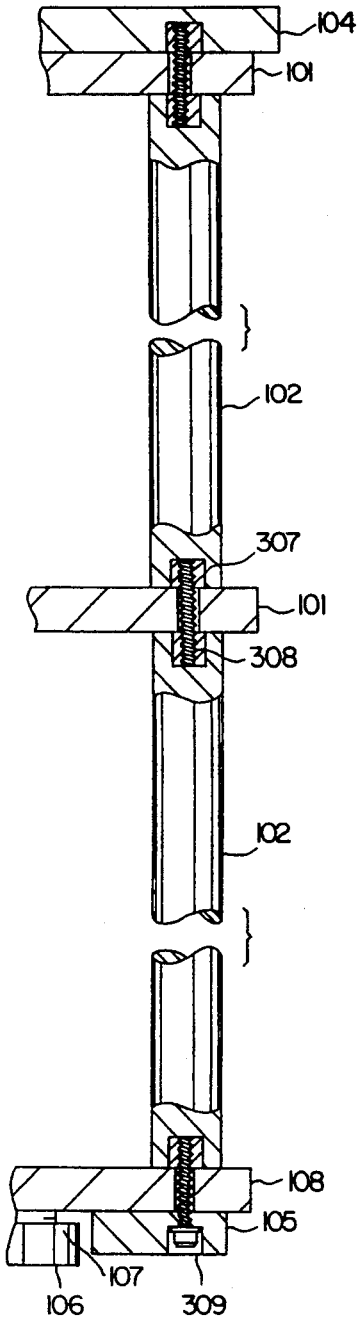
FIG. 3B is a view along the line 3—3 of FIG. 1 showing a first integration of the support means with skirt when the standoff assembly has set-screw/insert as securing means.
Figure 3C:
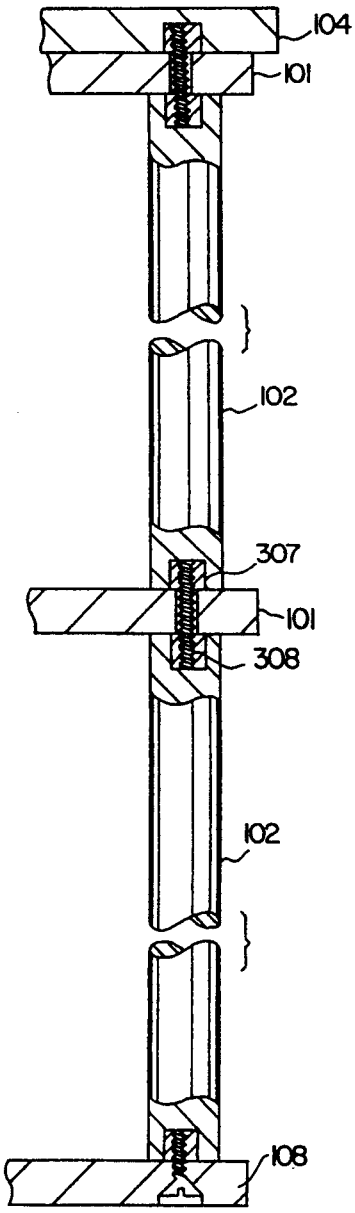
FIG. 3C is a view along the line 3—3 of FIG. 1 showing a second integration of the support means without skirt when the standoff assembly has set-screw/insert as securing means.
Figure 3D:
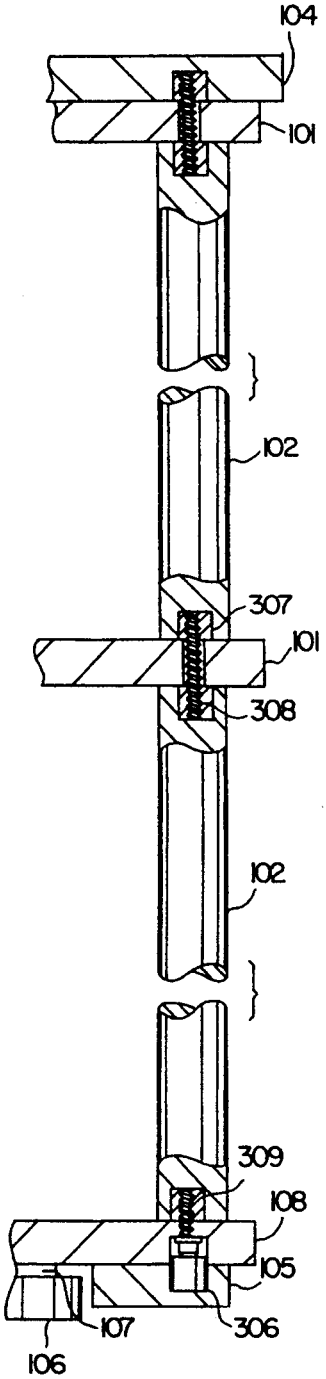
FIG. 3D is a view along the line 3—3 of FIG. 1 showing a third integration of the support means with skirt when the standoff assembly has set-screw/insert as securing means.

Three variations of standoff/shelf interface assemblies of the second preferred embodiment are illustrated in FIGS. 3B, 3C, and 3D. Other types of interfaces such as may be used without departing from the spirit of this invention.

The embodiment of the storage unit using set-screw-/insert pairs is typically assembled in an upside-down position. The cover panel is positioned with its top side facing down and its "insert side" facing up. The top shelf panel is then centered on the cover panel so that its sixteen holes are aligned with the cover panel's sixteen threaded inserts. The top shelf panel is then sandwiched and locked into this precise position by the standoffs, whose set-screws are passed through the sixteen panel clearance holes and then tightly assembled into the threaded inserts in the cover panel. This procedure precisely locates the sixteen standoffs and rigidly maintains them in their proper positions perpendicular to the panels.

To assemble a single-tiered storage unit, the bottom shelf panel is then similarly assembled to the exposed standoff inserts; however, flat head or cap screws are used in lieu of standoffs with inserted set-screws, to assemble and lock the bottom shelf panel in position. The sixteen holes at the underside of the bottom shelf panel are countersunk or counterbored for flat head or cap screws (see FIGS. 3C and 3D).

A skirt can be attached to a storage unit in various ways. First, it can include dowel pins which fit into and are glued into the counterbored corner holes in the bottom shelf panel (see FIG. 3D). Second, the screws used to attach the corner standoffs to the bottom shelf panel can also be used to simultaneously attach the skirt to the bottom shelf panel (see FIG. 3B). The skirt serves a decorative function by shrouding the base, and enhancing their structures apparent continuity with the floor on which it stands. The skirt also reinforces and strengthens the bottom shelf. By attaching the skirt through the bottom shelf to the lowest set of support members it further strengthens the whole shelf unit and reduces torsion and bending stresses under heavy load.

To assemble a two-tiered storage unit, before the bottom shelf assembly step described above, a second shelf panel is positioned over the exposed inserts of standoff extending from the first panel so that its clearance holes align with the inserts. The panel is then assembled to these standoffs, by means of a second set of identical standoffs, in the manner and procedure employed to assemble the first shelf panel. The bottom shelf panel and skirt are then added to the assembly as described above.

The assembly procedure for a three-tiered or a four-tiered storage unit is essentially the same as described above but with a correspondingly larger number of standoffs and shelf panels.

Thus, for this second preferred embodiment each standoff or vertical support is provided at each end with an insert having an internally threaded cylinder to accept a machine screw. Such inserts are commercially available and can conveniently be assembled into each end of the vertical supports. The insert at one end of the support is provided with an inserted metal set-screw that is of sufficient length to extend through a hole of the shelf panel and into an insert provided on the opposite side of the shelf panel by another vertical support or by a cover panel.

In a typical construction, a cover panel is provided with a pattern of such inserts that matches the pattern of holes provided in each shelf panel. All shelf panels contain the same pattern of throughholes which is determined by the arrangement pattern for the standoffs. All holes have identical clearance diameters for the machine screws.

For an arrangement as shown in FIG. 3D, for the bottommost shelf panel, each throughhole is counterbored from the bottom side. The counterbore provides a recessed shoulder against which to secure a head screw that is fully recessed in the panel. The bottom shelf panel is then secured to the last set of the vertical supports using head screws threaded into the inserts of said vertical support set.

The top shelf panel is attached to the cover panel by inserting the metal set-screw extended from one end of each vertical support through the hole provided in the shelf panel, and threading the emerging set-screw end into the insert in the corresponding insert in the cover panel. In this preferred construction, there will now be 16 vertical supports securing the top shelf panel to the cover panel.

The next shelf panel is placed at the bottom of the supports, each of which contains the insert member of the set-screw/insert pair. The set-screws extending from the ends of a second set of vertical supports identical to the first set are then each inserted through the throughholes in the second shelf panel and secured to the inserts at the ends of the first set of vertical supports.

This process is continued, alternating shelf panels and support member sets, until the storage unit has the desired number of shelf panels.

The bottom shelf panel is secured using head screws which seat in counterbored holes. The open bottom portion of the counterbored holes can then, if desired, be concealed by attaching a skirt panel using, for example, short dowel pins (see FIG. 3D).

The second preferred embodiment, which is a knockdown version of the first embodiment, entails on the one hand, somewhat more costly components, viz., standoffs and panels; however, the higher component costs are more than offset by the less elaborate general assembly tooling/facilities requirements and by the shorter lead and throughput times required to produce the general assemblies of the second embodiment. The bookcase's relatively light weight and its knockdown assembly feature also makes kitting for remote or on-site assembly a practical marketing consideration.

This storage unit is designed for ease of assembly and for its component parts to be compatible with the most current automatic woodworking equipment. These principles can be applied to other storage racks as well. The simple and redundant geometry of the variously tiered storage unit assembly structures, which can be adapted to storage of other items as desired, dictates that their assemblies will be self-aligning and self-spacing when they are fitted. When tenons are used as the securing means, the assemblies will be clamped and they will remain properly aligned if they are properly glued. For the set-screw/insert recurring means, the self alignment and self spacing is also design inherent. The precision, the repeatability and the efficiency of the most appropriate contemporary wood fabricating technology makes this unit, with its several attachments, a sturdy, reliable, precision assembly structure with a versatile utility that is both practical and feasible. The versatility of the unit's design and the versatility of its manufacturing process can be made easily manifest.

Given the same hardware and standoffs and blank panels, a mere substitution of panel drilling programs can produce a revolving tiered wine rack (FIG. 4) in lieu of a revolving tiered bookcase (FIG. 1), a different product for an entirely different market. This example, in addition to the floor-to-ceiling, revolving bookcase described earlier, is offered to suggest the invention's novelty, its utility, and the scope of its design as well as its relevant manufacturing processes.

Referring to FIG. 1, a two-tiered model of the revolving bookcase of the present invention is shown. Two shelf panels 101 and a bottom shelf panel 108 are shown, along with vertical support members or standoffs 102, of which there are four groups of four between each of the respective shelf panels. As shown in FIG. 1, four supports 102 form an L-shaped pattern wherein the three supports designated 102A form the long side of the L and the two supports 102B, one of which is shared with 102A, form the base of the L. As shown in FIG. 2, the base of the L (for example supports 102B) in one corner and two of the three supports (supports 102C in this example) of the long side of the L in the next corner, in the direction of the long side of the L, provide a pair of bookends, thereby defining the linear space of a storage bin for books. As further shown in FIG. 1, books indicated by dashed lines in the upper shelf position are arranged around the spaces on the shelf. Moreover, the dimensions of the spacing are such that magazines, lying flat, conveniently fit as well. As shown in FIG. 1, the top Of the rack is finished by a cover panel 104 which extends slightly beyond the adjacent shelf panel 101 at the top. Base 106, see FIGS. 2 an 3A, is shrouded by a skirt 105 which is recessed from the bottom shelf panel 108. Shelf panels, supports, and cover panels and skirt can be made of any convenient material, but lumber is preferred for ease of machining and for aesthetic appeal. There is no theoretical reason why, for example, plastic or metal could not be used as well, but these materials may be more difficult to adapt to the method of the invention and are certainly less conventional in construction of furniture of this type.

FIG. 2 is a cross-sectional '2—2' view of the unit. This figure clearly shows the L-shaped arrangement of the vertical supports and how books may be stored. As seen in FIG. 2, the supports 102A are just inside the edge of the shelf panel extending from the shelf corner to an "interior" point. The pair of supports 102B forms the base of the same L and extends inward from the edge and forms one bookend of a bookend set. The other bookend of the set is formed by two of the three supports 102C of the long side of the L which is located in the opposite corner of the same edge. Base 102D of this other L provides one end of a bookend set on the adjacent edge. Thus, a total of 4 sets of bookends, comprised of 16 dowels, are distributed in a basket weave pattern about the periphery of each shelf panel.

FIG. 2 further shows the location of base 106 which is secured to the unit through a display turntable so as to provide free rotation of the unit about the base. This rotation means may be implemented with commercially available bearing systems. Rotating attachment 107 (see FIG. 3A) provides attachment points for engaging both the bottom shelf panel 108 of the unit to be rotated and the base 106.

FIGS. 3A through 3E show the means for the attachment of the vertical support members to the shelf panels; also shown is a section of the base which is connected through the rotating attachment means 107, (only partially visible in FIGS. 3A, 3B, 3D) to inserts assembled in blind holes in the bottom shelf panel 108. Also shown, in FIGS. 3A, 3B, and 3D, are skirts which shroud base 106 when the unit is viewed from its side.

As shown in FIG. 3A, the support members 102 are extended by tenons 301 which are conveniently formed by machining the cylindrical vertical supports 102 to provide square-shouldered tenons. The length of a tenon extension is such that it is equal to approximately one-third but less than one-half the thickness of a shelf panel 101 as shown. Thus, support members 102 are engaged in panels 101 by means of insertion into a hole 302 which has been drilled through the panel. Holes 302 are almost filled by the combination of tenons 301 from the upper and lower support members 102. Similarly, skirt 105 and cover panel 104 are secured by short dowels 306 to bottom panel 108, respectively, top must panel utilizing cavities of the same dimension shown as 303 in skirt 105 and as 304 in cover panel 104.

Thus, it can be seen that the unit can be manufactured in an extremely simple way by standardizing the arrangement of the supports and the method of their attachment. Shelf panels 101 are uniformly provided with 16 holes drilled through the thickness of the panels arranged as shown in FIG. 2. Vertical support members 102 are provided with square-shouldered tenons 301 of a diameter to fit the holes in panels 101 and 108 (see FIG. 3A). All vertical support members are identical (except for length, if different height tiers are desired). The weight-carrying portions of the unit are assembled by inserting the vertical support members 102 into the bottom shelf panel 108, laying on the next panel 101 so that the opposite ends of support members 102 can be inserted into the corresponding holes of the next panel 101, and adding support members 102 and panels 101 alternately for the desired number of tiers. The top shelf panel 101 is then covered with cover panel 104, which can be secured to the top shelf panel 101 by 4 short dowels which are aligned with the outside corner support members 102 of the shelf panels 101 and of the dimensions suitable for the cavity as shown in FIG. 3A. Thus, the cavity pattern in cover panel 104 corresponds to the outside corner hole pattern of shelf panels 101 except that the cavities extend only part way through the thickness of cover panel 104. Dowel pegs 306 secure cover panel 104 to the top shelf panel 101.

Skirt 105 is attached in a manner similar to that used for the cover panel as further shown in FIG. 3A. Skirt 105 has four cavities 303, one at each corner to receive dowel pegs 306.

Skirt 105 and base 106, whose disc diameter is slightly smaller than the circular aperture in the center of the square skirt 105, can (conveniently and completely in the same machine setup) be fabricated from the same square blank panel by including in the operational sequence—subsequent to all hole drilling—a final circular routing operation that separates the two parts. Appropriate inserts for attachments are then assembled to base 106. The inserted tenons and dowels of the storage unit are preferably held in place with an adhesive; however, the structure is quite stable under load (even without adhesive) when fits are tight.

Similar advantages are found in an assembly using set-screw/insert pairs as the securing means, as shown in FIGS. 3B, 3C and 3D. Again, all shelf panels 101 are identically drilled except for bottom shelf panel 108 whose holes on its bottom side are either counterbored or countersunk, depending upon the method used to attach skirt 105. Similarly, skirt 105 and cover panel 104, in this embodiment, have the same hole or cavity patterns or a portion thereof as the shelf panels. The vertical support members 102 are identical throughout, however, when using set screw/insert means for assembly of the unit—each vertical support has an insert 307 at each end, and a set-screw 308 screwed into one of the two inserts 307 and extending for a correct length to pass through a hole in a shelf panel 101 to be screwed into an insert 307 in a cover panel or a support member 102 of the next storage tier. For a 3-tiered storage unit, 48 vertical supports of this type would be required, one cover panel containing 16 inserts, 3 shelf panels with 16 clearance holes of diameter approximately that of the set-screw, and one bottom shelf panel with 16 similar clearance holes that are counterbored or countersunk from the panel's bottom surface. In addition, 16 cap screws 309 are used to secure bottom shelf panel 108 to the vertical support members of the lowest storage tier. Optionally, a skirt 105 with suitable cavities or holes may be attached and secured to the bottom shelf panel with four cap screw 309 or short dowels 310 (see FIGS. 3B and 3D). The attachment of base 106 in a rotating manner is as described for the depicted embodiment which follows.

Figure 3E:
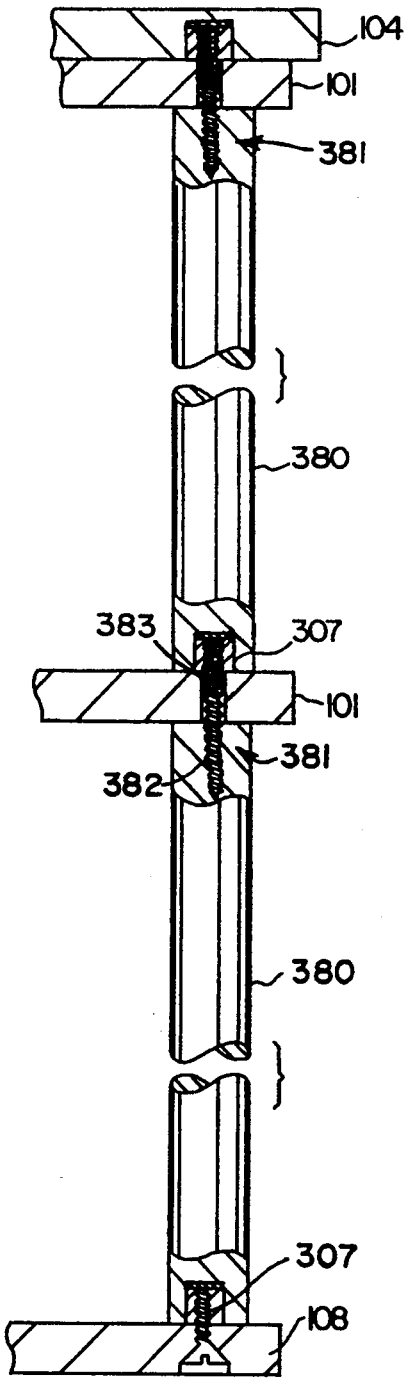
FIG. 3E is a view along the line 3—3 of FIG. 1 showing the second integration of the support means without skirt (FIG. 3C) when the standoff assembly has hanger bolts/insert as securing means.

In FIGS. 3B, 3C and 3D the vertical support members are connected by set screws which are screwed into inserts having machine screw type threads. For a less labor intensive assembly hanger bolts can be used as shown FIG. 3E. FIG. 3E is a view along the line 3—3 of FIG. 1 showing the second integration of the support means without skirt (FIG. 3C) when the standoff assembly has hanger bolts/insert as securing means. The principle shown in FIG. 3E can be applied to the assemblies illustrated in FIGS. 3*b* and 3D in the same manner. Each of the vertical support members 380 has a machine screw type receiving insert 307 in one end and an hanger bolt 381 in the other end. Hanger bolts 381 have a wood screw thread 382 and a machine screw thread 383 at the other end. Prior to assembly an hanger bold 381 is screwed into an end 384 of vertical support member 380. End 384 of vertical support member 380 has previously be centered and may have a predrilled hole for receiving the hanger bolt. The second end of each vertical support member has a blind hole for receiving the machine screw type insert as discribed with reference to FIGS. 3B, 3C and 3D.

Returning to the illustrative embodiment shown in FIGS. 1 and 2, bottom shelf panel 108 is attached to base 106 through rotating attachment means or turntable 107. Rotating attachment means 107 is first secured to inserts in positions 603 in base 106 (see FIG. 7). The rotating attachment means 107 is then attached to inserts in positions 414 assembled in underside of bottom shelf panel 108 (see FIG. 2). Base 106 may be provided with casters 601, glides 501 (FIG. 5) or other supporting members as shown in FIG. 6.

Figure 7:
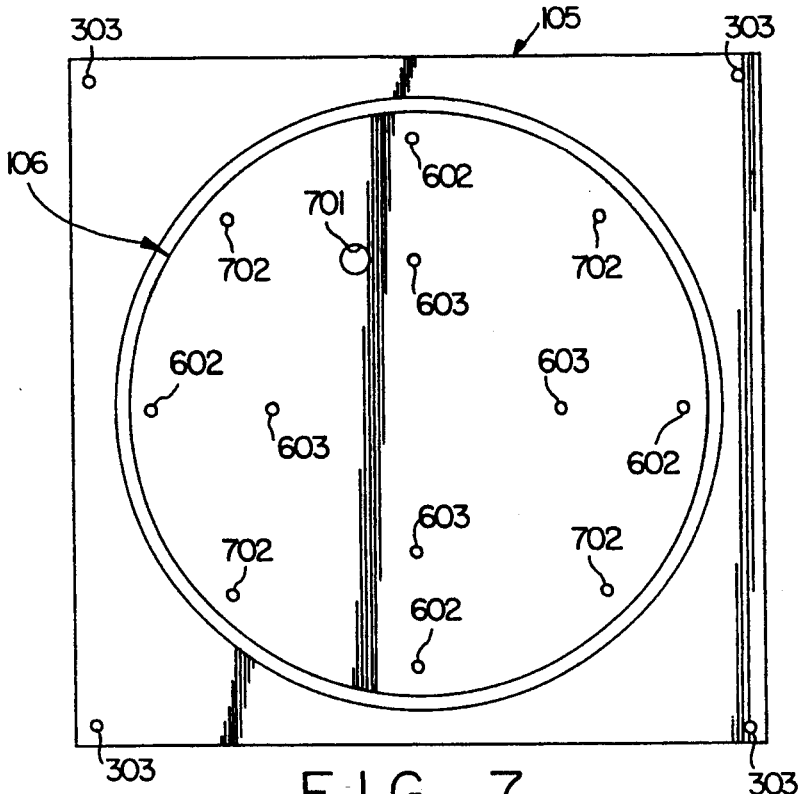
FIG. 7 shows details of one embodiment of the attachment of the rotating unit to the base.

FIG. 7 is a more detailed view of the surfaces of base 106 and skirt 105 before their respective attachments to the underside of the turntable 107 and the underside of the storage unit. Skirt 105 is secured to the bottom shelf panel 108 by means of four short dowels (FIG. 3A) or cap screws (FIG. 3B); the layout of the cavities or counterbored holes 303 in skirt 105 are shown in FIG. 7.

FIG. 7 shows the base 106 subsequent to its routing from the center of a panel, which yields base 106 and skirt 105. The attachment of skirt 105 to the bottom shelf panel 108 is further secured by glue if dowels are used.

Base 106 is attached to the turntable/rotating attachment means 107 by four cap screws in positions 603. After attachment of the rotating attachment means 107 to base 106, the assembly is secured to bottom shelf panel 108 by means of four additional cap-screws which are inserted through the access hole 701 in base 106. The position of the access hole 701 is determined by the design of the turntable used as rotating attachment means 107. Base 106 is provided with cavities 602 and 702 to accommodate adjustable glides and/or casters.

Convenient dimensions for an illustrative embodiment of the units of the invention include $20\frac{1}{4}$ by $20\frac{1}{4}$ inch panels supported by vertical supports of 1-inch diameter having $11\frac{1}{2}$ or $10\frac{1}{2}$ inch lengths, depending on the size of books desired to be accommodated. For these dimensions, approximately 11 linear feet of book space is provided by a three-tiered unit. A three-tiered unit can readily support several hundred pounds of weight.

In this illustrative embodiment when secured by tenons (FIG. 3A), the panels are conveniently approximately $\frac{3}{4}$ inch thick, and the tenons at the ends of the dowels are thus 5/16 inch long. They are conveniently $\frac{3}{8}$ inch in diameter, and the $\frac{3}{8}$ inch diameters of the holes drilled in the shelf panels are thus designed to accommodate this thickness.

In the illustrative design shown in FIG. 1, cover panel 104 extends approximately $\frac{1}{4}$ inch over the top panel 101 on each side; Skirt 105 is recessed by $\frac{1}{4}$ inch from the edges of bottom panel 108.

For the embodiment wherein the securing means are set-screw/insert pairs (FIG. 3B), typical inserts have an internal thread of about 0.2 inch diameter—the typical insert depth is about $\frac{1}{2}$ inch. The set-screws for a $\frac{3}{4}$ inch shelf panel design are about $1\frac{3}{4}$ inch. Thus, the set-screw extensions from the vertical supports extend about $1\frac{1}{4}$ inch beyond the end of the supports. The dowel-accommodating portion of the throughholes of the bottom shelf panel for securing the skirt can be identical to the that described above.

Of course it is not necessary to utilize cylindrical vertical supports as standoffs in the construction, although this makes for an extremely convenient manufacturing process. One could also use, to form the L-shaped bookends, angle irons, bricks, and the like.

The design of the revolving, tiered storage unit is made practical and feasible by the rapid and precise between-centers hole drilling capability of the (automatic) CNC machine on which its various panels can be drilled. This repeatable (programmed) capability reliably insures the precise positioning and coincidental and coaxial alignment of the respective major axes of each of the 16 sets of (1, 2, 3 or 4) press-fitted or set-screw/insert-fitted cylindrical standoffs and the 8 small dowels which, in combination with the standoffs, connect and space the shelves and panels of the storage unit. (The major axis of each square-shoulder cylindrical standoff and the major axis of each of its two square-shoulder cylindrical tenons are also fabricated to be coincidental). The foregoing relationships are strong advantages of the design and structure of this storage unit (and its manufacturing process) and serve to constrain the assembly (in the set-screw/insert embodiment when it is assembled, and in the tenon embodiment when it is glued and clamped) into a strong self-aligning and self-spacing integral structure whose shelves and panels are parallel.

Importantly, the same approach is useful in the construction of storage units wherein the horizontal and vertical spacing of the standoffs or vertical support members is designed to accommodate a certain desired item. Thus, as set forth above, this approach is equally advantageous in the construction of the wine rack shown in FIGS. 4–6 and 8, or in storage units intended for other items such as sweaters or shirts, jars, cans, storage bins, or other packaged units.

Figure 4:
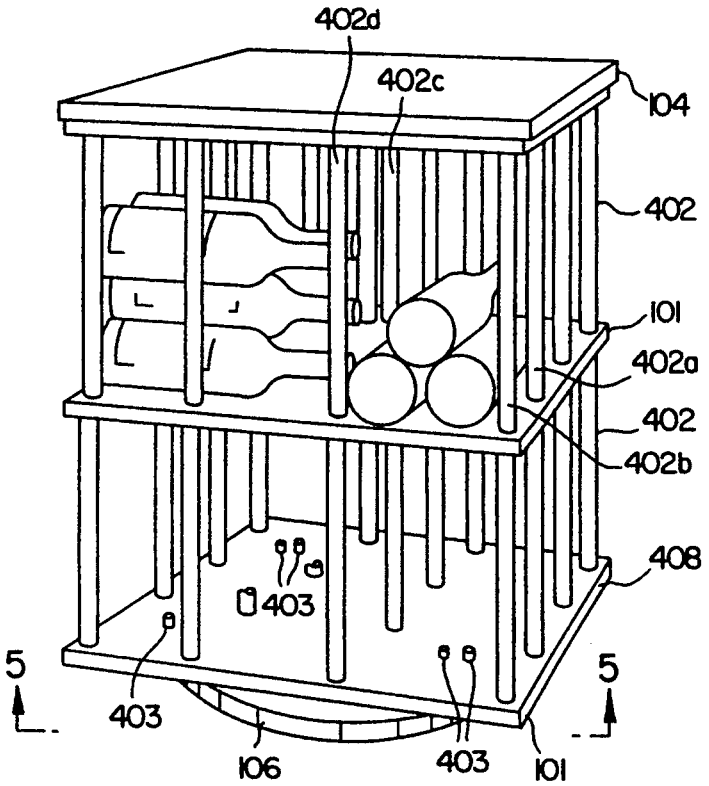

FIG. 4 shows an adaptation of the manufacturing method of the invention to construction of a revolving wine rack. As shown in FIG. 4, without its skirt, the arrangement of vertical support members 402 along shelf panels 101 is reconfigured in order to accommodate an arrangement of horizontally-stacked wine bottles. Although the layout of support members 402 is different, the advantages of strength and ease of construction are retained. The design shown in FIG. 4 also utilizes sixteen vertical support members or standoffs 402 arranged in four L-patterns; but in this arrangement the layout of the standoffs is arranged to accommodate the intended different use. Storage per shelf is provided for four sets of six bottles lying flat as shown. The bottles are supported laterally by two vertical supports on either side. For example, as shown in FIG. 4, the four support members 402*a* through 402*d* support the bottles shown at the right of the figure. In addition, two pegs or short dowels 403 in each bin help retain the bottle(s) in the desired location when only one or two bottles remain in the segment or storage bin of the storage unit provided.

Figure 5:
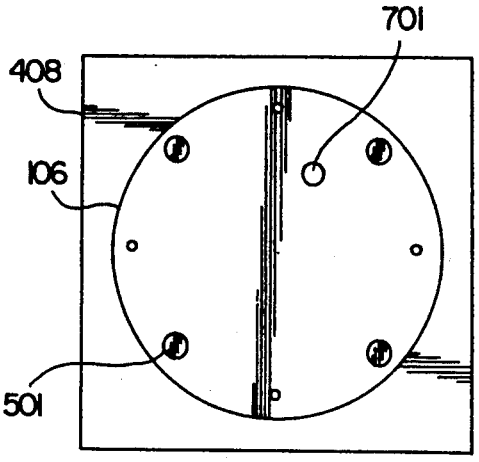
FIG. 5 shows a base view along the line 5—5 of FIG. 4.
Figure 6:
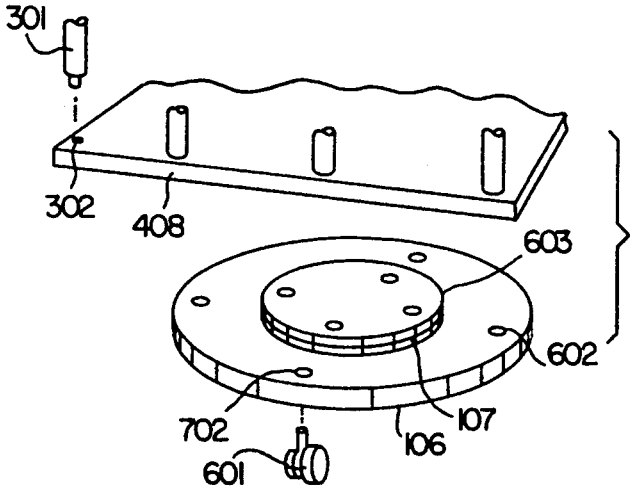
FIG. 6 shows details of one embodiment of the attachment of a rotating base and vertical support members.

FIG. 5 shows a bottom view of the wine rack of FIG. 4 along the line 5—5. This is identical with the base of the storage unit of FIG. 1, except for the absence of a skirt surrounding the base. As more clearly shown in FIG. 5, base 106 is attached to bottom shelf panel 408 through a rotating attachment means, which is not shown in FIG. 5. Base 106 includes glides 501 which permit the unit to seat comfortably on a floor surface.

FIG. 6 shows rotating attachment means 107 secured to base 106 which is in this example provided with casters 601. The insertion of the tenons 301 as securing means into the cavities 302 in bottom shelf panel 408 is also shown. This embodiment of FIG. 6 does not show a skirt, but such a storage unit may include a skirt.

Figure 8:
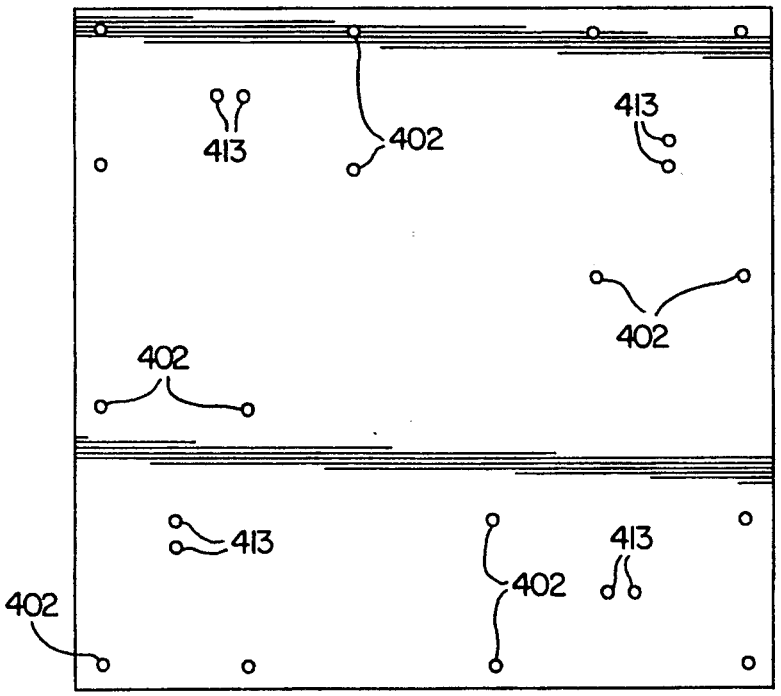
FIG. 8 shows a top view of the hole pattern layout for the vertical standoffs and pegs of the wine rack shown in FIG. 4.

FIG. 8 is a diagram of the panel hole layout for the vertical supports 402 of the wine rack shown in FIG. 4. It also shows the locations of the blind holes 413 ($\frac{3}{8}''$ deep) that accommodate the $\frac{3}{8}'' \times \frac{3}{4}''$ long bottle retaining dowels 403, which may be placed loosely in holes 413 or may be permanently affixed in holes 413.

Figure 9:
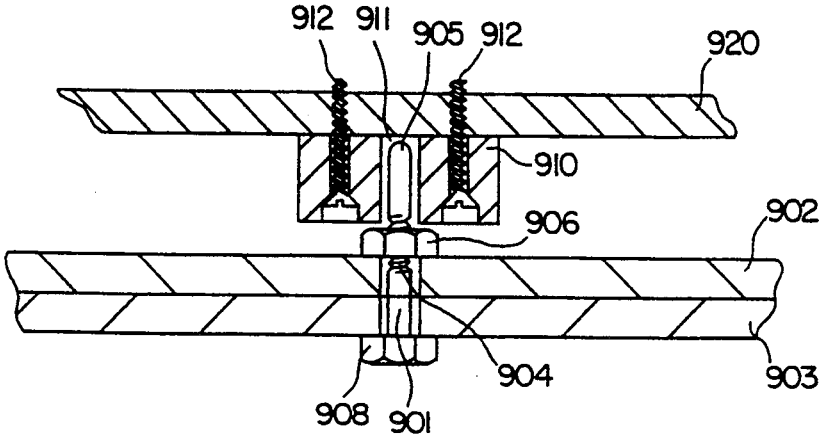
FIG. 9 is an illustration of a method for anchoring a floor-to-ceiling revolving storage shelf unit in a typical ceiling.

FIG. 9 is an illustration of a ceiling anchor for a floor-to-ceiling revolving storage shelf unit. Floor-to-ceiling storage shelf units may be secured against tumbling by a ceiling anchor. Such a ceiling anchor is shown in FIG. 9 and consist of an axial shaft 901 mounted through the centers of cover panel 902 and the highest shelf panel 903. Axial shaft 901 includes a threaded length 904 and an unthreaded length 905 with a smooth surface. Threaded length 904 may only partially cover the shank of shaft 901 between unthreaded length 905 and head 908. Shaft 901 is secured to panels 902 and 903 by nut 906. The anchor point in or at the ceiling is an axial ceiling sleeve bearing 910 which has a hole 911 for receiving the unthreaded length 905 of axial shaft 901. In FIG. 9 two screws 912 secure sleeve bearing 910 to a sturdy section of ceiling 920. Sleeve bearing 910 may be cylindrical or square or be a part of the ceiling construct. Its sole function is to provide a fixed axial bearing surface, opening 911, for receiving axial shaft 901. Hole 911 may be counterbored from the top side to reduce the bearing surface.

In all preferred designs, the most convenient embodiment employs a set of 16 support members or standoffs which consists of 4 subsets. The members of each subset are arrayed in a coaxial pattern about the center axis of the revolving (rotating) storage unit. As the unit is rotated, four support members (one member from each subset) traverse the same orbit. As used herein, "coaxial" refers to positions equidistant from a common axis. Thus, the support members provide 4 arrays of coaxially spaced supports which stabilize the rotation by virtue of this symmetry.

In all preferred designs, the most convenient embodiment consists of a set of identical square panels that are interspaced, in a tiered configuration, by sets of 16 identical standoffs or support members. The standoff layouts between panels are identical, each consisting of four identical minor layouts or subsets, one of which emanates from each of the four panel corners. In this tiered configuration, all of the standoffs are perpendicular to their respective panels and parallel to the panels' common center line and to the general assembly's axis of rotation; also the major axis of any standoff at any given location, e.g., a panel corner location, is coincidental with the major axis of the corresponding standoff in the tier immediately above and/or below it. Therefore, the vertical support members of a general assembly consist of 16 sets of standoffs whose respective members have 16 coincidental axes. The loci of motion of these standoffs are a set of four concentric annular cylinders whose common axis is the general assembly's axis of rotation; furthermore, the spacing of the standoffs, along their respective loci of motion, is equidistant.

The extensive redundancy, the unique internal alignments, and the mutually reinforcing features that characterize this structure contribute directly to: its strength and stability, its balance and load distribution means, its economy of space and materials, and its functional utility and simplicity.

In alternative designs, the spatial relationships of identical sets of standoffs, that separate respective panels, can be varied according to use; however, in all cases the standoffs remain coaxial and coincidental as described above.

What I claim is:

1. A revolving storage shelf unit comprising:

at least three shelf panels including a bottom shelf panel and a top shelf panel;

said shelf panels being square planar members, each having four corners and four edges;

a cover panel;

a plurality of vertical support members vertically interspacing adjacent shelf panels and defining storage bins, each of said vertical support member having an axis and two planar ends substantially perpendicular to said axis, each of said vertical support members includes an insert for receiving screw type fasteners in one of said ends axially mounted with said axis, and an anchor bolt type fastener in the other one of said ends axially mounted with said axis, said anchor bolt type fastener having a wood screw type end and a machine type screw end, said machine screw type end matching said insert for receiving machine screw type fasteners;

said vertical support members interspacing the same shelf panels constituting a set of vertical support members;

each set of vertical support members being arranged in "L" patterns, said "L" patterns extending from each corner of a shelf panel with the long side of each L parallel to and proximal to one edge of said shelf panel and extending to a point on said edge, the base of said L extending inward from said edge at said point, the base of the "L" at a first corner along with the long side of an "L" at a second, adjacent corner defining one of said storage bins, said "L" patterns of different shelf panels being coaxially arranged, and corresponding vertical support members of said "L" patterns of different shelf panels being axially aligned;

said cover panel including means for receiving screw type fasteners in locations corresponding to the arrangement of said vertical support members; wherein said panels having openings for passing said screw type fasteners in locations corresponding to the arrangement of said vertical support members; said bottom panel having openings for receiving screw type fasteners in locations corresponding to the arrangement of said vertical support member; said top shelf panel being mounted between said cover panel and the highest set of vertical support members in said shelf unit, additional shelf panels being mounted between vertically adjacent sets of vertical support members, and said bottom panel being attached to the lowest set of vertical support members;

a base secured to the bottom of said bottom shelf panel in a freely rotating manner.

2. The revolving storage unit as claimed in claim 1 which further comprises a bottom skirt panel attached to said bottom shelf.

3. The revolving storage unit as claimed in claim 1 wherein said cover panel includes inserts axially aligned with vertical support members of said set of vertical support members, and wherein said top shelf panel is secured between a set of said vertical support members and said cover panel by said set screw type fasteners.

4. The revolving storage unit as claimed in claim 1 further comprising a bottom shelf strengthening skirt panel attached to said bottom shelf, said skirt panel including holes axially aligned with selected vertical support members of said lowest set of vertical support members, and wherein said bottom shelf panel is secured between said selected vertical support members and said skirt panel and attached to not selected vertical support members of said lowest set of vertical support members by screw type fasteners.

5. The revolving storage unit as claimed in claim 2 or 4 wherein said skirt panel includes recessed holes axially aligned with vertical support members of said set of vertical support members, and wherein said bottom shelf panel is secured between said vertical support members and said skirt panel by head screws, the heads of said head screws being recessed in said recessed holes.

6. A method to manufacture a storage unit, which storage unit comprises one shelf panel, a cover panel, bottom shelf panel, and a plurality of vertical support members;

which method comprises providing said cover panel with inserts for receiving screw type fasteners, said inserts being placed on the underside of said cover panel in a pattern of four L-shaped subpatterns at the four corners of the cover panel, oriented with the side of the L along the edge of the panel and the base extending inward from an interior point along the edge;

providing each of said vertical support members at one of said ends with axially mounted insert for receiving screw type fasteners, attaching an hanger bolt having a wood screw type end and a machine screw type end, with said wood screw type end to said vertical support member providing cavities in the shelf panels in a pattern of four L-shaped subpatterns at the four corners of the shelf panels, oriented with the side of the L along the edge of the panel and the base extending inward from an interior point along the edge, and of such dimensions as to accommodate said machine screw type end of said hanger bolt, said anchor bolt constituting a first screw type fastener;

providing cavities in said bottom shelf panel in a pattern of four L-shaped subpatterns at the four corners of the shelf panels, oriented with the side of the L along the edge of the panel and the base extending inward from an interior point along the edge, and of such dimensions as to accommodate a second type of screw type fasteners;

placing said shelf panel over the underside of said cover panel with said cavities in said shelf panel aligned with said inserts in the underside of said cover panel; attaching said vertical support members with said first type of screw type fasteners through said cavities in said shelf panel to said inserts in said cover panel; placing said bottom shelf panel over said vertical support members with said cavities in said bottom panel aligned with said inserts in said vertical support members and attaching said bottom panel with a second type of screw type fasteners to said inserts of said support members.

7. A method to manufacture a storage unit, which storage unit comprises at least two shelf panels, a cover panel, a bottom shelf panel, and a plurality of sets of vertical support members, said method comprising the steps of:

providing said cover panel with inserts for receiving a first type of screw type fasteners, said inserts being placed on the underside of said cover panel in a pattern of four L-shaped subpatterns at the four corners of the cover panel, oriented with the side of the L along the edge of the panel and the base extending inward from an interior point along the edge; providing each of said said vertical support members with an insert for receiving a first screw type fasteners, said insert being axially mounted in one end of said vertical support members;

attaching an anchor bolt having a wood screw type end and a machine screw type end to the other end of said vertical support members with the machine screw type end extending from said vertical support member, said hanger bold constituting a first screw type fastener;

providing cavities in the shelf panels in a pattern of four L-shaped subpatterns at the four corners of the shelf panels, oriented with the side of the L along the edge of the panel and the base extending inward from an interior point along the edge, and of such dimensions as to accommodate said first type of screw type fasteners;

providing cavities in said bottom shelf panel in a pattern of four L-shaped subpatterns at the four corners of the shelf panels, oriented with the side of the L along the edge of the panel and the base extending inward from an interior point along the edge, and of such dimensions as to accommodate a second type of screw type fasteners;

placing a first one of said shelf panels over the underside of said cover panel with said cavities in said first shelf panel aligned with said inserts in the underside of said cover panel and attaching the vertical support members of a set of vertical support members with said first screw type fasteners through said cavities in said first shelf panel to said inserts in said cover panel;

placing another one of said shelf panels over said support members with said cavities in said another shelf panel aligned with said inserts in said vertical support members and attaching another set of vertical support members with said attached first screw type fasteners through said cavities of said another shelf panel to said inserts of said previously mounted vertical support members; and repeating the steps of attaching a set of vertical support members and placing a another one of said shelf panels until all sets of vertical support members of the storage unit are installed;

placing said bottom shelf panel over the last mounted vertical support members with said cavities in said bottom shelf panel aligned with said inserts in said last mounted vertical support members and securing said bottom panel with a second type of screw type fasteners to said inserts of said support members.

8. The method of claims 6 or 7 further including the steps of securing a base through a rotating attachment means to said bottom shelf panel of said storage unit.

9. The method of claims 6 or 7 wherein said storage unit includes a skirt panel, and wherein said step of providing cavities in said bottom shelf panel includes providing a recess for said second type of screw type fasteners and accommodation for a dowel pin at selected ones of said cavities, and wherein said method further includes the additional step of:

providing cavities in said skirt panel in a pattern aligned with said selected ones of said cavities in said bottom panel and of a dimension as to accommodate said dowel pins; and attaching said skirt panel to said bottom panel with said dowel pins.

10. The method of claims 6 or 7 wherein said storage unit includes a skirt panel, and wherein said method includes the additional step of:

providing recessed cavities in said skirt panel in a pattern aligned with selected positions of said L patterns in said shelf panels and of a dimension to accommodate said second type of screw type fasteners; and wherein said step of providing cavities in said bottom shelf panel in a pattern of four L-shaped subpatterns at the four corners of the shelf panel, oriented with the side of the L along the edge of the panel and the base extending inward from an interior point along the edge, includes providing cavities aligned with said selected positions and of a dimension to accommodate the shaft of said second type of screw type fasteners, and recessed cavities to accommodate said second type of screw type fasteners aligned with said cavities aligned with said selected positions of said L patterns which are inward from said interior point at said edge of said shelf panels;

wherein said step for placing and attaching said bottom shelf panel to said vertical support members with said second type of screw type fasteners, includes said bottom shelf panel and said skirt panel.

11. The method of claim 6 or 7 including steps for the simultaneous fabrication of a base and a skirt panel in a single setup from one blank panel, said steps including providing said block panel having a center, and routing a circular path around said center of said blank panel, thereby providing said base and said skirt panel in one routing operation.

12. The method of claim 8 further comprising a step for providing said bottom shelf panel with inserts for receiving screw type fasteners, a step for providing said base with inserts for receiving screw type fasteners, and wherein said step for securing said rotating attachments means includes a first sub-step of attaching said rotating attachment means to said insert in said base, and a second sub-step for attaching the assembly of rotating attachment means and base to said bottom panel.

13. The method of claim 11 wherein said step for providing a blank panel includes the step, prior to routing, for providing an access hole in the base panel and holes for attaching said skirt panel to said bottom shelf panel and providing cavities for receiving caster assembly, and for inserts for screw type fasteners, said inserts being arranged for attaching adjustable glides and a rotating attachment means to the base.

14. The method of claim 8, wherein said storage unit further comprises means for attaching selectively adjustable glides or caster assemblies to said base wherein said step for providing a blank panel includes the step preliminary to routing for providing an access hole in the base and holes for attaching said skirt panel to said bottom shelf panel and providing cavities for caster assemblies and for receiving inserts for screw type fasteners, said inserts being arranged for attaching adjustable glides and a rotating attachment means to said base.

* * * * *